US007867103B2

(12) United States Patent
Salmon

(10) Patent No.: US 7,867,103 B2
(45) Date of Patent: Jan. 11, 2011

(54) SYSTEMS AND DEVICES FOR CONTROLLED PUTTING

(76) Inventor: D'Miles Salmon, P.O. Box 719, Jacksonville, OR (US) 97530

( * ) Notice: Subject to any disclaimer, the term of this patent is extended or adjusted under 35 U.S.C. 154(b) by 459 days.

(21) Appl. No.: 11/974,410

(22) Filed: Oct. 12, 2007

(65) Prior Publication Data

US 2008/0096683 A1 Apr. 24, 2008

Related U.S. Application Data

(63) Continuation-in-part of application No. 10/811,451, filed on Mar. 25, 2004, now Pat. No. 7,286,230.

(60) Provisional application No. 60/460,076, filed on Apr. 2, 2003, provisional application No. 60/934,775, filed on Jun. 14, 2007.

(51) Int. Cl.
*A63B 69/36* (2006.01)

(52) U.S. Cl. ..... 473/221; 473/242; 473/257

(58) Field of Classification Search ..... 473/219, 473/220, 224, 226, 242, 251, 252, 253, 254, 473/257, 266, 268
See application file for complete search history.

(56) References Cited

U.S. PATENT DOCUMENTS

| | | | | |
|---|---|---|---|---|
| 4,979,745 A | | 12/1990 | Kobayashi | 273/186 |
| 4,979,754 A | | 12/1990 | Eisenhart | 273/411 |
| 5,169,151 A | * | 12/1992 | Conley | 473/220 |
| 5,324,039 A | | 6/1994 | Reimers et al. | 273/186.1 |
| 5,330,188 A | * | 7/1994 | Reimers | 473/151 |
| 5,419,562 A | | 5/1995 | Cromarty | 273/183.1 |
| 5,692,964 A | * | 12/1997 | Smith et al. | 473/220 |
| 5,980,393 A | | 11/1999 | Molinaroli et al. | 473/220 |
| 6,095,928 A | | 8/2000 | Goszyk | 473/222 |
| 6,248,021 B1 | * | 6/2001 | Ognjanovic | 473/131 |
| 6,371,864 B1 | * | 4/2002 | Norwood | 473/220 |
| 6,375,579 B1 | | 4/2002 | Hart | 473/131 |
| 6,402,634 B2 | | 6/2002 | Lee et al. | 473/223 |
| 6,821,211 B2 | | 11/2004 | Otten et al. | 473/219 |
| 6,923,728 B1 | | 8/2005 | Lin | 473/220 |

(Continued)

OTHER PUBLICATIONS

"Wrong putting exercises may possibly harm your golf." www.dixxgolf.com/eng/intro/sub_01_1.asp.

*Primary Examiner*—Nini Legesse
(74) *Attorney, Agent, or Firm*—JAG Patent services LLC; James A. Gavney Jr.

(57) ABSTRACT

A putting system with a putter substrate and modules that detachably couple to the putter substrate to form a putter head is disclosed. The modules detect, determine, measure and/or monitor alignment and/or tempo of the putter head. Modules include displays and/or audio outputs that provide visual and/or audio representations of the alignment and/or the tempo of the putter head. In accordance with the embodiments of the invention, the system includes a target module for generating alignment signals that are received by a positioning module with a built-in receiver unit. Preferably, the transmitter unit includes an array of infrared transmitters and the receiver unit includes an array of infrared detectors. In operation the positioning module is configured to detect, determine, measure and/or monitor angular alignment of the putter head with respect to the target module based on intensities of the alignment signals received at each of the infrared detectors. In accordance with further embodiments of the invention the system includes weight modules with a range of weights and weight balances.

16 Claims, 19 Drawing Sheets

U.S. PATENT DOCUMENTS

| | | | | |
|---|---|---|---|---|
| 6,935,965 | B1 * | 8/2005 | DeVarney | 473/224 |
| 6,988,955 | B2 * | 1/2006 | Stoakes | 473/242 |
| 7,182,697 | B2 | 2/2007 | Zamora | 473/251 |
| 7,214,138 | B1 | 5/2007 | Stivers et al. | 473/199 |
| 2002/0173365 | A1 | 11/2002 | Boscha | 473/131 |
| 2004/0106092 | A1 * | 6/2004 | Galanis et al. | 434/252 |
| 2007/0105637 | A1 | 5/2007 | Shimizu | 473/151 |
| 2007/0105639 | A1 | 5/2007 | Hasegawa | 473/221 |

* cited by examiner

SYSTEMS AND DEVICES FOR CONTROLLED PUTTING

RELATED APPLICATION(S)

This patent application is a continuation-in-part of the U.S. patent application Ser. No. 10/811,451 filed Mar. 25, 2004 now U.S. Pat. No. 7,286,230 and entitled "ALIGNMENT SYSTEM, DEVICE AND METHOD," which claims priority under 35 U.S.C. 119 (e) of the U.S. Provisional Patent Application Ser. No. 60/460,076, filed Apr. 2, 2003, and titled "ALIGNMENT SYSTEM, DEVICE AND METHOD."

This patent Application also claims priority under 35 U.S.C. 119 (e) of the U.S. Provisional Patent Application Ser. No. 60/934,775, filed Jun. 14, 2007, and titled "SYSTEMS AND DEVICES FOR CONTROLLED PUTTING."

The U.S. patent application Ser. No. 10/811,451 filed Mar. 25, 2004 and entitled "ALIGNMENT SYSTEM, DEVICE AND METHOD," the U.S. Provisional Patent Application Ser. No. 60/460,076, filed Apr. 2, 2003, and titled "ALIGNMENT SYSTEM, DEVICE AND METHOD and the U.S. Provisional Patent Application Ser. No. 60/934,775, filed Jun. 14, 2007, and titled "SYSTEMS AND DEVICES FOR CONTROLLED PUTTING" are all hereby incorporated by reference.

FIELD OF THE INVENTION

The invention relates to golfing systems, devices and methods. More particularly, the present invention relates to golfing systems, devices for and methods of controlling putting.

BACKGROUND OF THE INVENTION

While putting, a golfer aligns the putter with a golf ball and a target location. Preferably, the golfer generally looks at the ball and the club (not the target) and strikes the ball moving the putter in a straight line through the golf ball to direct or project the golf ball towards the target. Good putting technique includes swing alignment, swing posture and swing tempo to name a few. Accordingly, what is needed is a system, device for and method of controlling or assisting in controlling a golfer's putting techniques.

SUMMARY OF THE INVENTION

The present invention putting system includes a putter substrate with a handle and modules that detachably couple to the putter substrate to form a putter head. Preferably, the modules detect, determine and/or monitor alignment and/or tempo of the putter substrate as the putter head moves back and forth through the putting trajectory towards a target. The module, the putter substrate and/or the handle of the putter substrate preferably include displays and/or an audio output that provides visual and/or audio representations of the alignment and/or the tempo of the putter head as the putter head moves back and forth through the putting trajectory.

In accordance with the embodiments of the invention, the display, such as described above, includes light emitting diode light bars or light emitting diode light arrays that are configured to selectively light-up and provide the visual representation of an angular alignment of the putter head with a target and/or the tempo of the putter head as the putter head moves back and forth.

In accordance with further embodiments of the invention, a putting system includes a positioning module. The positioning module measures, detects and/or monitors the angular position of the putter head with respect to the target. The positioning module includes a receiver unit with an array of infrared detectors for receiving alignment signals for a target unit, with the target unit located or positioned at or near the target. The alignment signals are generated by a transmitter unit within the target unit. The array of infrared transmitters are preferably infrared light emitting diode transmitters. In operation, infrared alignment signals are transmitted from the transmitter unit and the positioning module measures, detects and/or monitors the angular position of the putter head with respect to the target based on the intensities of the alignment signals received at each of the infrared detectors.

In accordance with this embodiment, the positioning module also includes a computing circuit. The computing circuit includes logic that is configured to determine or calculate the angular position of the putter head with respect to the target or target unit based on the intensities of the infrared alignment signals received at each of the infrared detectors. The computing circuit then provides output signals to the display, which generates the visual representation of the angular alignment of the putter head with respect to the target or target module.

In accordance with still further embodiments of the invention, a system includes a set of weight modules having a range of weights to provide a golfer with a range of putter weights and weight balances. In still further embodiments of the invention a weight module includes a set of weights configured to interchangeably fit into one or more receiving cavities on the weight module to provide the golfer with a wide range of putter weights and weight balances.

DETAILED DESCRIPTION OF THE INVENTION

Figure 1A:
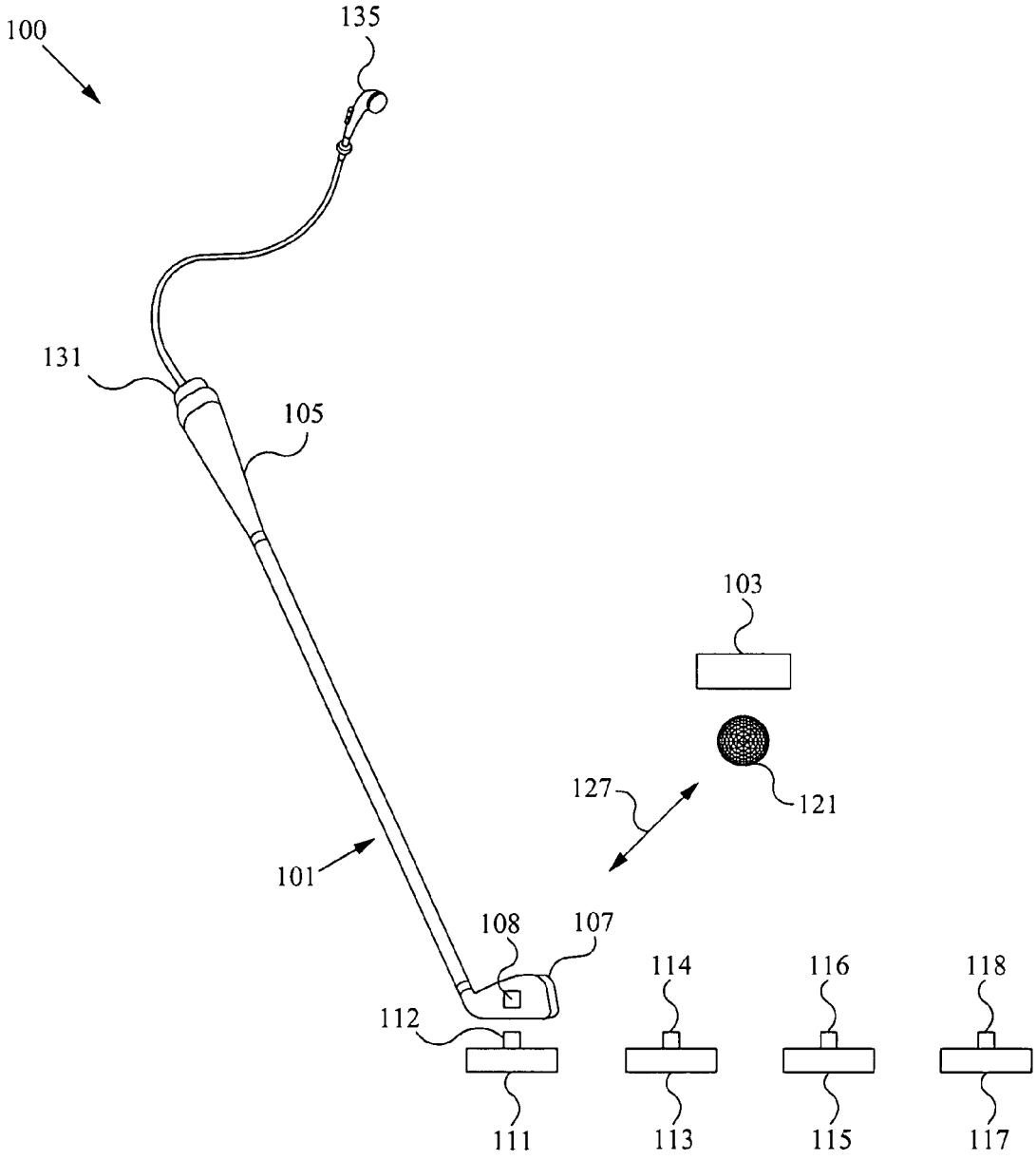
FIG. 1A shows a putting system with a putter substrate and a plurality of detachable modules, in accordance with the embodiments of the invention.

Referring to FIG. 1A, the present invention is directed to a system 100 for putting a golf ball 121. The system 100 includes a putter assembly 101 with a putter substrate 107 and a handle 105. The system 100 further includes a plurality of modules 111, 113, 115 and 117 configured to detachably couple to the putter substrate through attachment features 108, 112, 114, 116 and 118 to form a putter head. Preferably, the modules 111, 113, 115 and 117 detect, determine measure and/or monitor alignment and/or tempo of the putter head as the putter head moves back and forth through the putting trajectory towards a target 103. One or more of the modules 111, 113, 115 and 117 can include a display (not shown) to provide a visual representation the alignment and/or the tempo of the putter head as the putter head moves back and forth through the putting trajectory. Further, the system 100 can also include audio output for providing an audio representation of the tempo of the putter head as the putter head moves back and forth through the putting trajectory. For example, the audio output includes an ear phone 135 that plugs into an audio output socket 131 located on a portion of the handle 105.

Figure 1B:
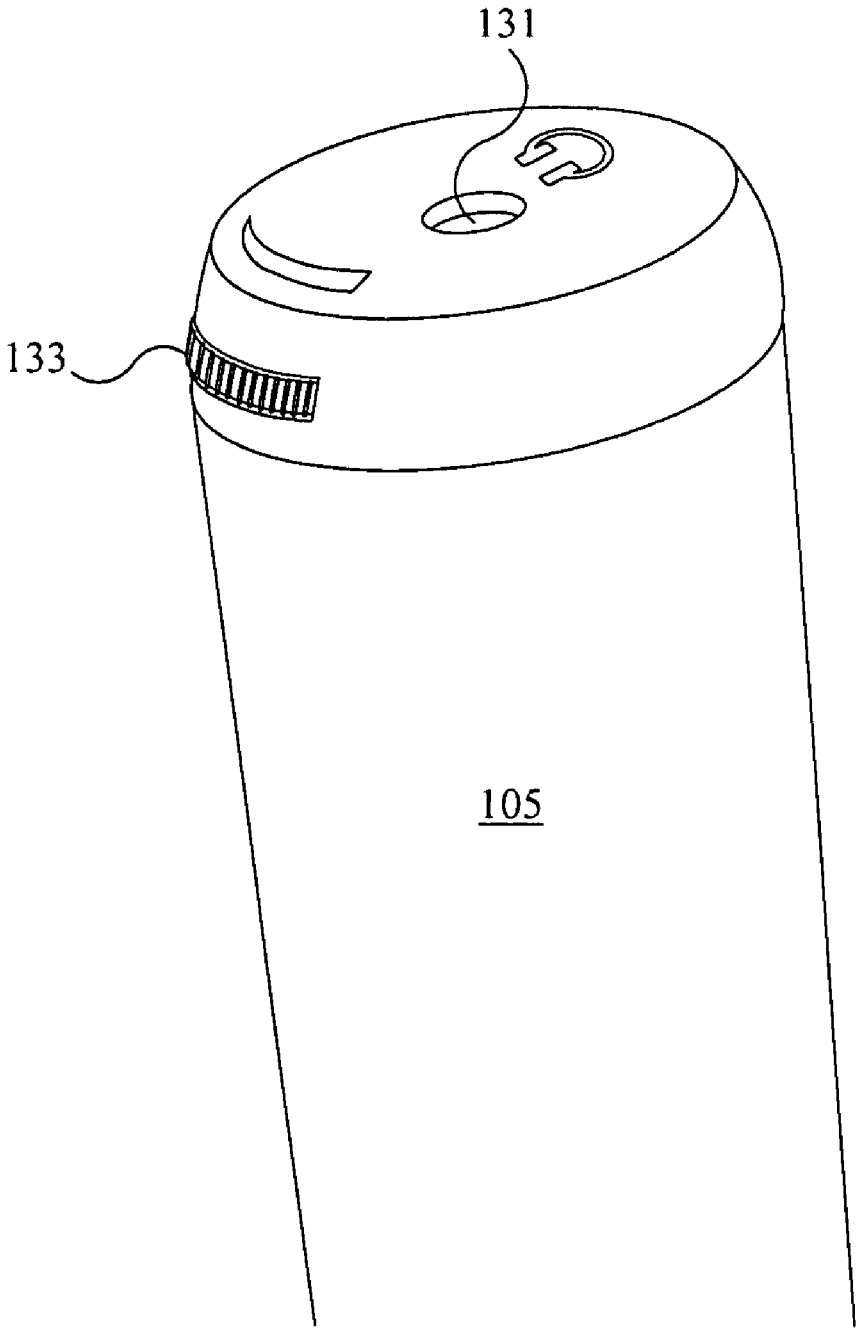
FIG. 1B shows a handle of a putter substrate with an ear phone outlet and a volume control for controlling volume of audio output from the putter substrate to an ear phone, in accordance with the embodiments of the invention.

FIG. 1B shows a view of the handle 105 of the putter assembly 101 (FIG. 1A), in accordance with the embodiments of the invention. As described above, the handle 105 has the audio output socket 131 for plugging in an earphone and/or headphone to receive an audio representation of the tempo of the putter head as the putter head moves back and forth through the putting trajectory. The handle 105 also preferably includes a rotary volume control switch 133 for adjusting a volume of the audio representation received through the ear phone and/or head phone.

Figure 2:
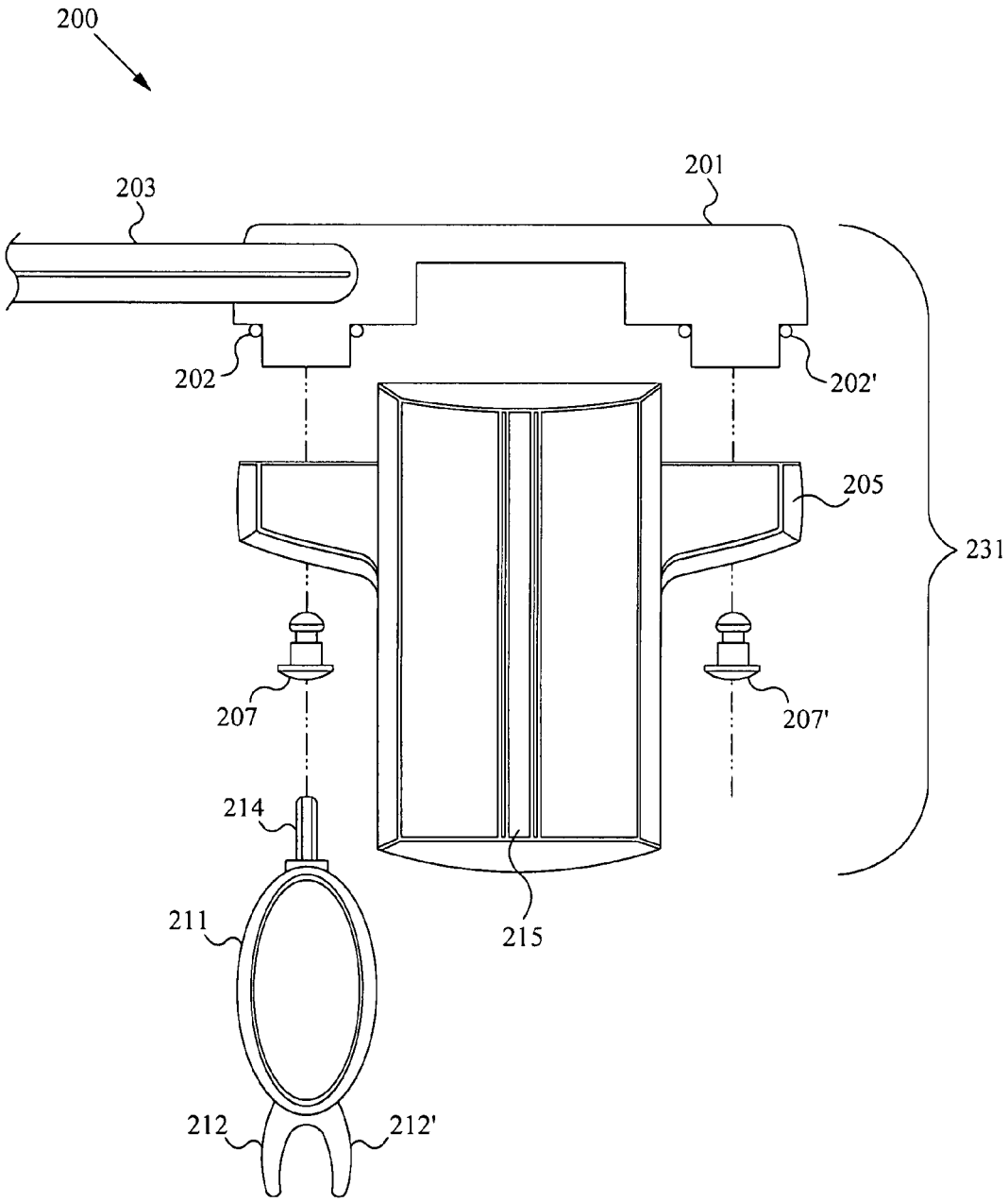
FIG. 2 shows a module configured to detachably couple to a putter substrate through a set lock screws or key features, in accordance with the embodiments of the invention.

Referring to FIG. 2, a putting system 200 include a putter substrate 201, a handle 203 and at least one module 205 configured to detachably couple to the putter substrate 201 through a set lock screws or key features 207 and 207' to form a putter head. The lock screws or key features 207 and 207' are configured to be treaded or fitted into the putter substrate 201 to secure the module 205 using a hand-held wrench 211. The hand-held wrench 211 can include a driver head 214, that is a hex-head or any other head that is geometrically matched to mate with and/or engage the lock screws or key features 207 and 207'. The hand-held wrench 211 preferably also includes prongs 212 and 212' for fixing divits on a golf course, cleaning divits from golf shoes and clubs and/or removing spikes from golf shoes.

Preferably, the module 205 includes a display 215 that provides or generates a visual representation of the alignment and/or tempo of the putter substrate 201 as the putter head 201 moves back and forth through the putting trajectory with the module 205 attached thereto. The display 215 can include a light emitting diode array or bars located on a top portion of the module 205, such described in detail below.

Still referring to FIG. 2, in accordance with a preferred embodiment of the invention the putting system 200 further includes a vibration dampener 202 and 202'. The vibration dampener 202 and 202' is preferably positionable between the putter substrate 201 and the module 205, while the module 205 is coupled to the putter substrate 201 through the lock screws or key features 207 and 207'. For example the vibration dampener 202 and 202' is a compression ring formed from a suitable polymeric material. It will be clear to one skilled in the art from the description above and below that modules of the present invention can be configured to detachably coupled to the putter substrate 201 using any suitable mechanism including, but not limited to, clips, snaps, nut and bolts, fitted geometric features and combination thereof. Further, it will be clear to one skilled in the art from the description above and below that the vibration dampener 202 and 202' can include o-rings and/or gasket structures formed from cloth, felt, sponge foam or any other compressible and/or elastic material that can provide a cushion barrier between surfaces of the putter substrate 201 and the module 205 with module 205 attached to the putter substrate 201.

Figure 3A:
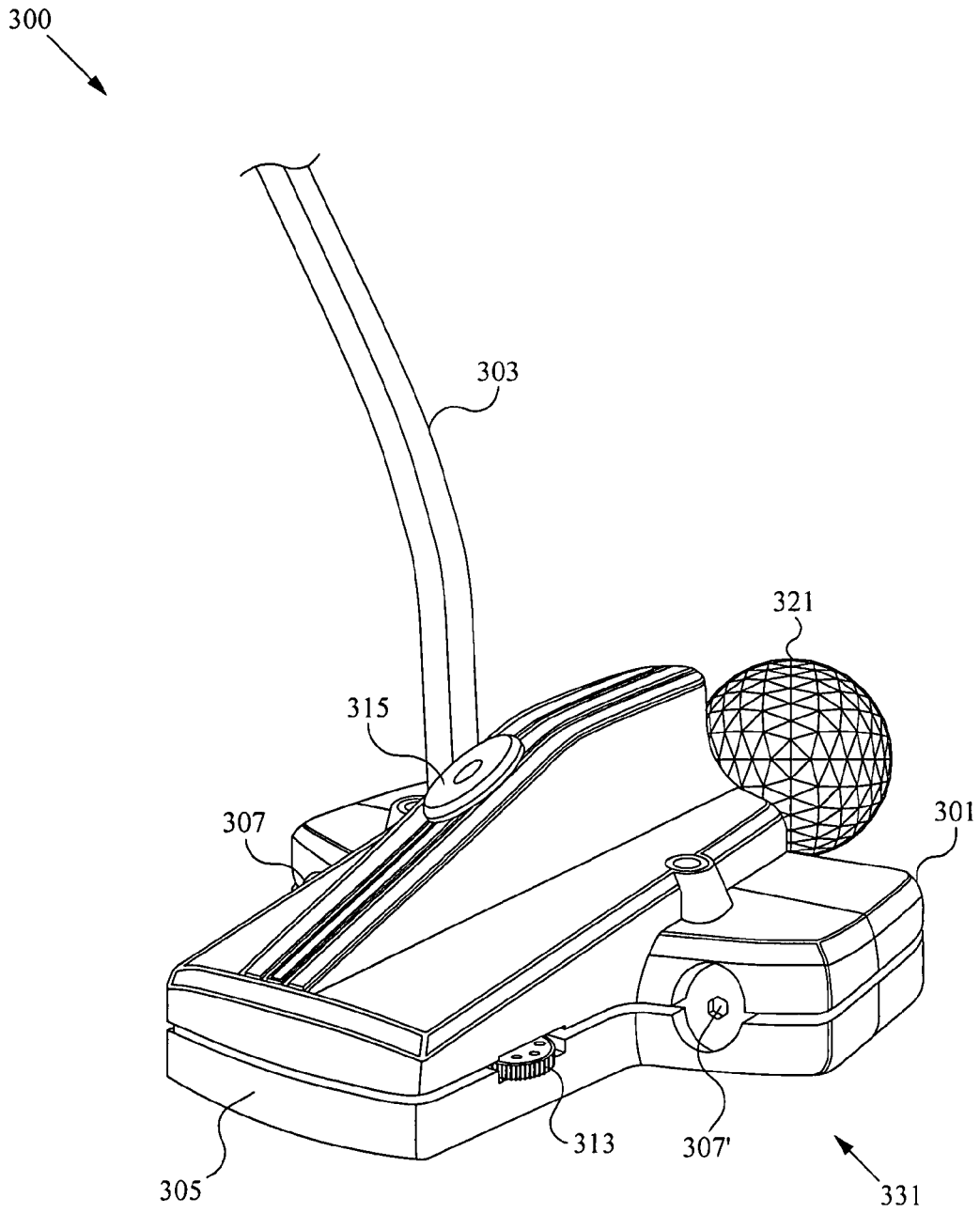
FIG. 3A shows a module with an adjustment feature coupled to a putter substrate, in accordance with the embodiments of the invention.

Referring now to FIG. 3A, in accordance with the further embodiments of the invention a putting system 300 include a putter substrate 301, a handle 303 and at least one module 305 that is configured to detachably couple to the putter substrate 301 through one or more set of lock screws or key features 307 and 307' to form a putter head 331, such as described above. The module 305 includes a display 315 that provides or generates a visual representation of the alignment and/or tempo of the putter head 331 as the putter head 331 moves back and forth through the putting trajectory with the module 305 attached thereto. In accordance with the embodiments of the invention, the module 305 also includes an adjustment feature 313 to adjust a sensitivity of the module 305 to detect, measure, determine and/or monitor changes in angular alignment and/or changes in the tempo of the putter head 331 as the putter head 331 moves back and forth through a putting trajectory to strike a golf ball 321.

Figure 3B:
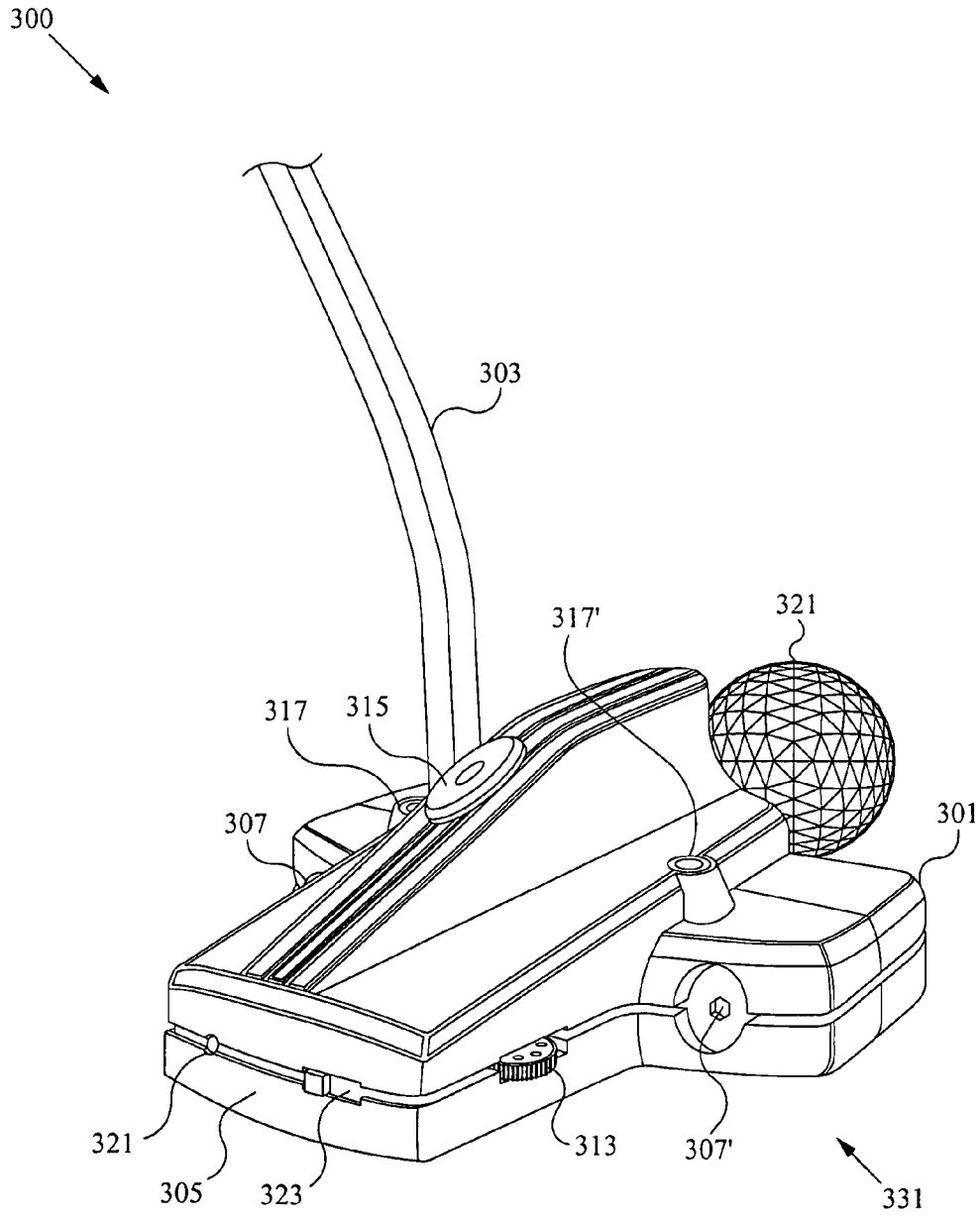
FIG. 3B shows a module coupled to a putter substrate, wherein the module includes a switch feature, and output port and an adjustment feature, in accordance with the embodiments of the invention.

Referring now to FIG. 3B, in accordance with still further embodiments of the invention the putting system 300 includes the putter substrate 301, the handle 303 and at least one module 305 that is configured to detachably couple to the putter substrate 301 through one or more sets of lock screws or key features 307 and 307' to form the putter head 331, such as described above with reference to FIG. 3A. Note that similar labels refer to the same elements throughout this Application. The module 305 preferably includes two directional light displays 317 and 317' in addition to the display 315 or in place of the display 315. The two directional light displays 317 and 317' indicate alignment of the module 305 and the putter substrate 301 with a target. The light displays 317 and 317' are preferably 5 mm "bug eye" light emitting diodes that illuminate green or any other suitable color when the module 305 and the putter substrate 301 are aligned with a target. One of the directional light displays 317 and 317' can be configured to illuminate alone or with a different color from that of the other of the displays 317 and 317', when the module 305 and the putter substrate 301 are out of alignment with the target.

Figure 4:
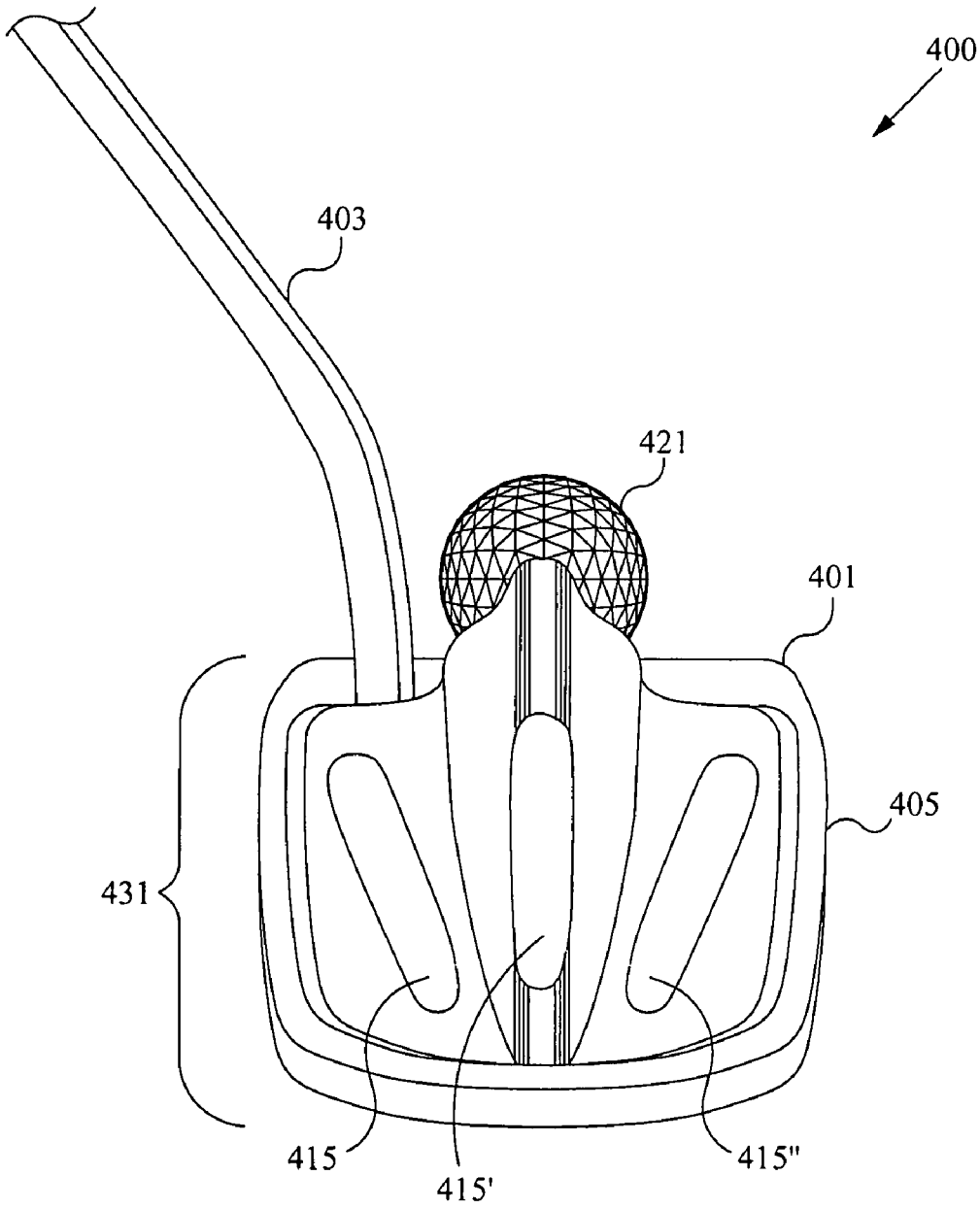
FIG. 4 shows a module with display features that include light bars with light emitting diode, in accordance with the embodiments of the invention.

Referring now to FIG. 4, in accordance with further embodiments of the invention a system 400 includes a putter substrate 401, a handle 403 and an alignment module 405, also referred to herein as "a positioning module," that detachably couples to the putter substrate 401 through one or more attachment features, such as described above and below, to form a putter head 431. The positioning module 405 includes a display to provide a visual representation of an angular alignment of the putter head 431 with a target. In accordance with an embodiment of the invention, the display includes a set of light bars 415, 415' and 415". The light bars 415, 415' and 415" are preferably illuminated using light emitting diodes. The light bars 415, 415' and 415" emit light of the same or of different colors.

In operation the light bars 415, 415' and 415" are configured to selectively light-up to provide the visual representation of the angular alignment of the putter head 431 with a target as the putter head moves back and forth through a putting trajectory to strike a golf ball 421. For example, when the putter head 431 is in angular alignment with the target (the striking surface of the putter head is perpendicular with the line of sight to the target), then the center light bar 415' is illuminated, while the outside light bars 415 and 415" remain off. If the putter head 431 is out of angular alignment or askew with the target (the striking surface of the putter head is not perpendicular with the line of sight to the target), then a corresponding one of the outside light bars 415 and 415" will light up to indicate that the putter head 431 is not in alignment with the target.

Figure 5:
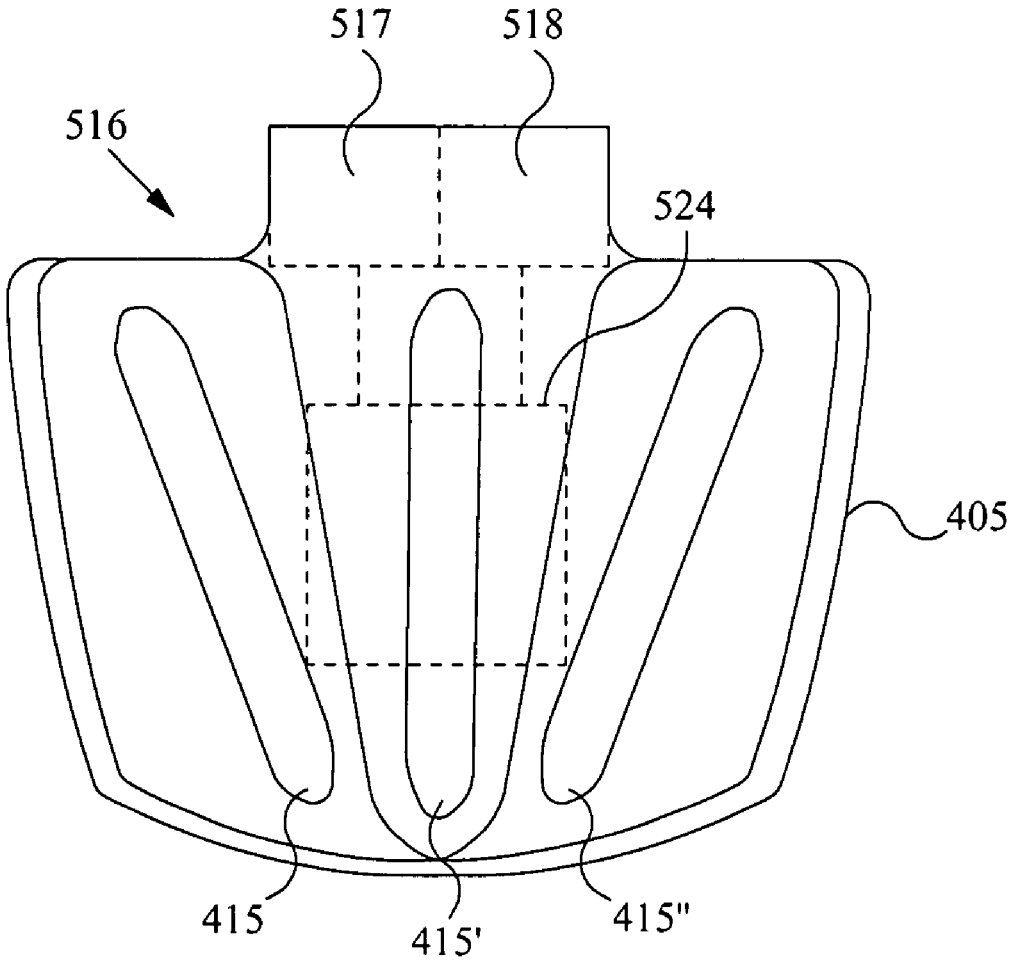
FIG. 5 shows a positioning module with a built-in receiving unit for detachably coupling to a putter substrate, in accordance with the embodiments of the invention.
Figure 9A:
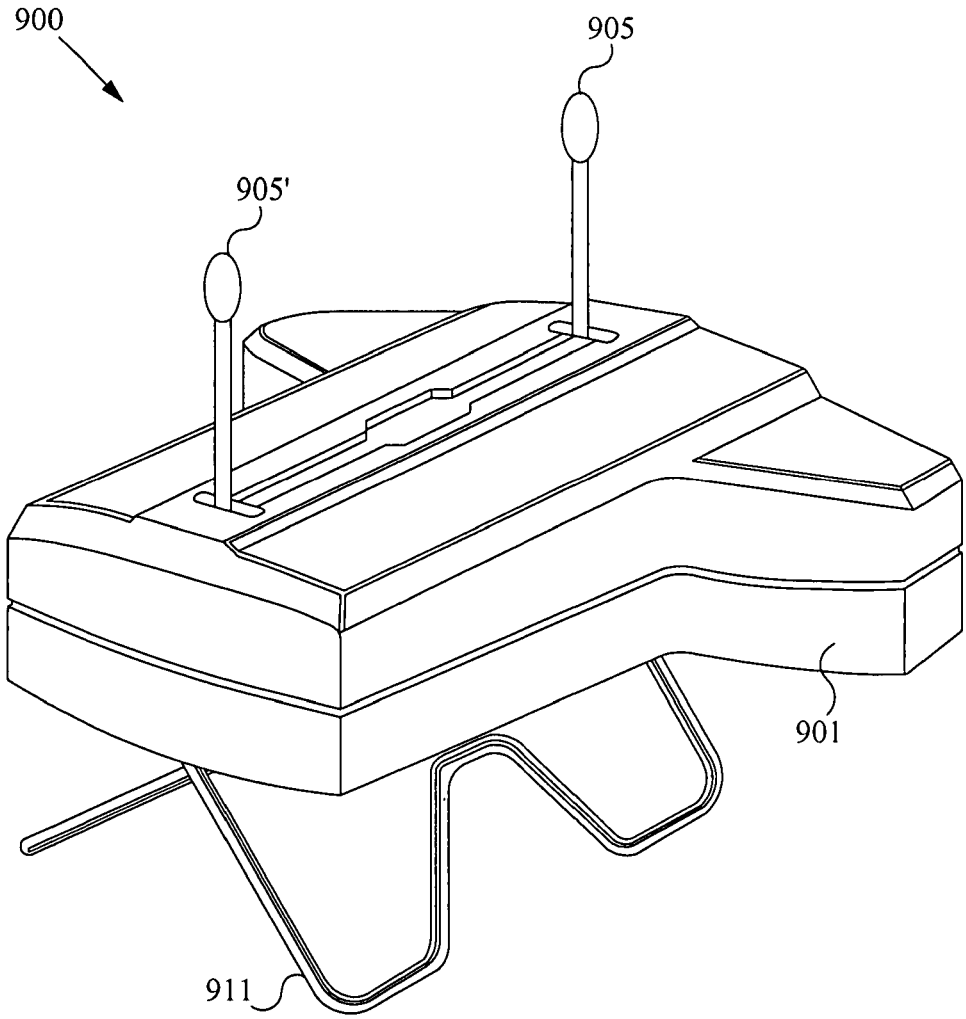
FIGS. 9A-C show a target module with a transmitter unit that includes an array of transmitters for generating alignment signals, in accordance with the embodiments of the invention.
Figure 9B:
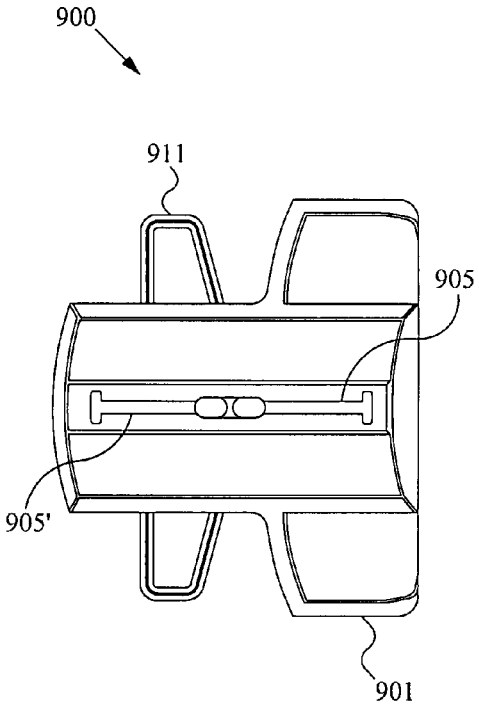
Figure 9C:
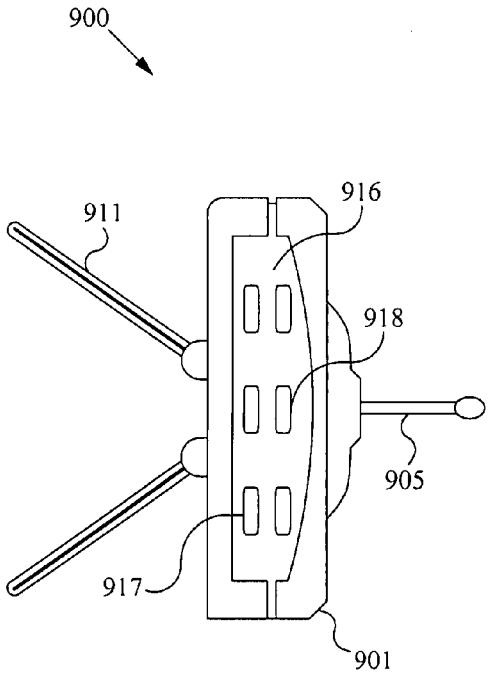

Referring to FIG. 5, the positioning module 405, such as described above includes a receiver unit 516. Preferably, the receiver unit 516 includes an array of detectors 517 and 518 for receiving alignment signals. The alignment signals are generated by a transmitter unit 916 (FIG. 9C) from a target unit 900 (FIGS. 9A-C). In all Figs., the same number refers to the same or similar element. Referring to FIGS. 4, 5 and 9A-C preferably, the alignment signals are generated in a path between a target or target module 900 and the putter head 431 (FIG. 4). In accordance with the embodiments of the invention, the array of detectors 517 and 518 includes electromagnetic detectors, such as radio detectors, optical detectors or a combination thereof. Most preferably, the array of detectors 517 and 518 includes infrared detectors for detecting infrared alignment signals generated from the transmitter unit 917 built into the target unit. The transmitter unit 9916 preferably includes an array of transmitters 917 and 918, such as an array of infrared transmitters. The positioning module 405 also includes a computing circuit 524 in electrical communication with the array of detectors 517 and 518. In accordance with this embodiment, the computing circuit 524 includes logic circuitry configured to determine or calculate an angular position of the putter head 431 with respect to the target or target unit 900 based on the intensities of infrared alignment signals received from the transmitters 917 and 918 at each of the infrared detectors 517 and 518. The computing circuit 524 then provides output signals to the display with the light bars 415, 415' and 415" to thereby generate a visual representation of the angular alignment of the putter head 431 with respect to the target or target module 900.

Figure 6A:
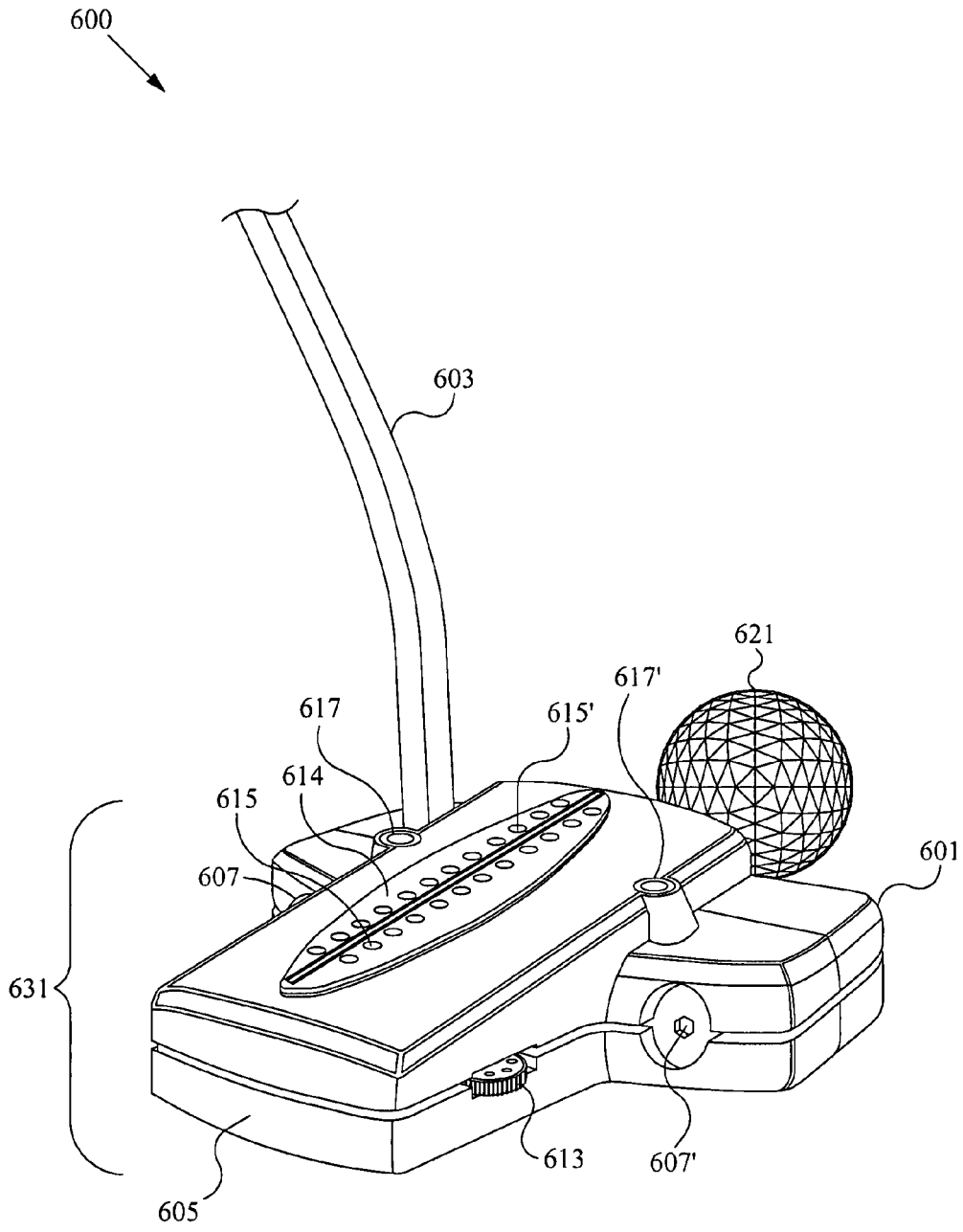
FIG. 6A shows an alignment module/tempo module with an array of lights and a sensitivity adjustment feature detachably coupled to a putter substrate, in accordance with the embodiments of the invention.

Referring to FIG. 6A, in accordance with further embodiments of the invention a putting system 600 includes a putter substrate 601, a handle 603 and a module 605 that detachably couples to the putter substrate 601 through one or more attachment features 607 and 607' to form a putter head 631. The module 605 includes a display 614 to provide a visual representation of an angular alignment of the putter head 631 with a target and/or a tempo of the putter head 631 as the putter head 631 swings with a back and forth motion to strike a golf ball 621. In accordance with an embodiment of the invention, the display 614 includes rows of lights 615 and 615'. The rows of lights 615 and 615' preferably are illuminated with light emitting diodes. In accordance with this embodiment of the invention, the module 605 includes an adjustment feature 613 to adjust a sensitivity of the module 605 to detect, measure, determine and/or monitor changes in angular alignment of the putter head 631 and/or the tempo of the putter head 631 as the putter head 631 swings with a back and forth motion. The module 605 can also include two directional light displays 617 and 617' that further indicate alignment of the putter head 631 with a target.

Figure 6B:
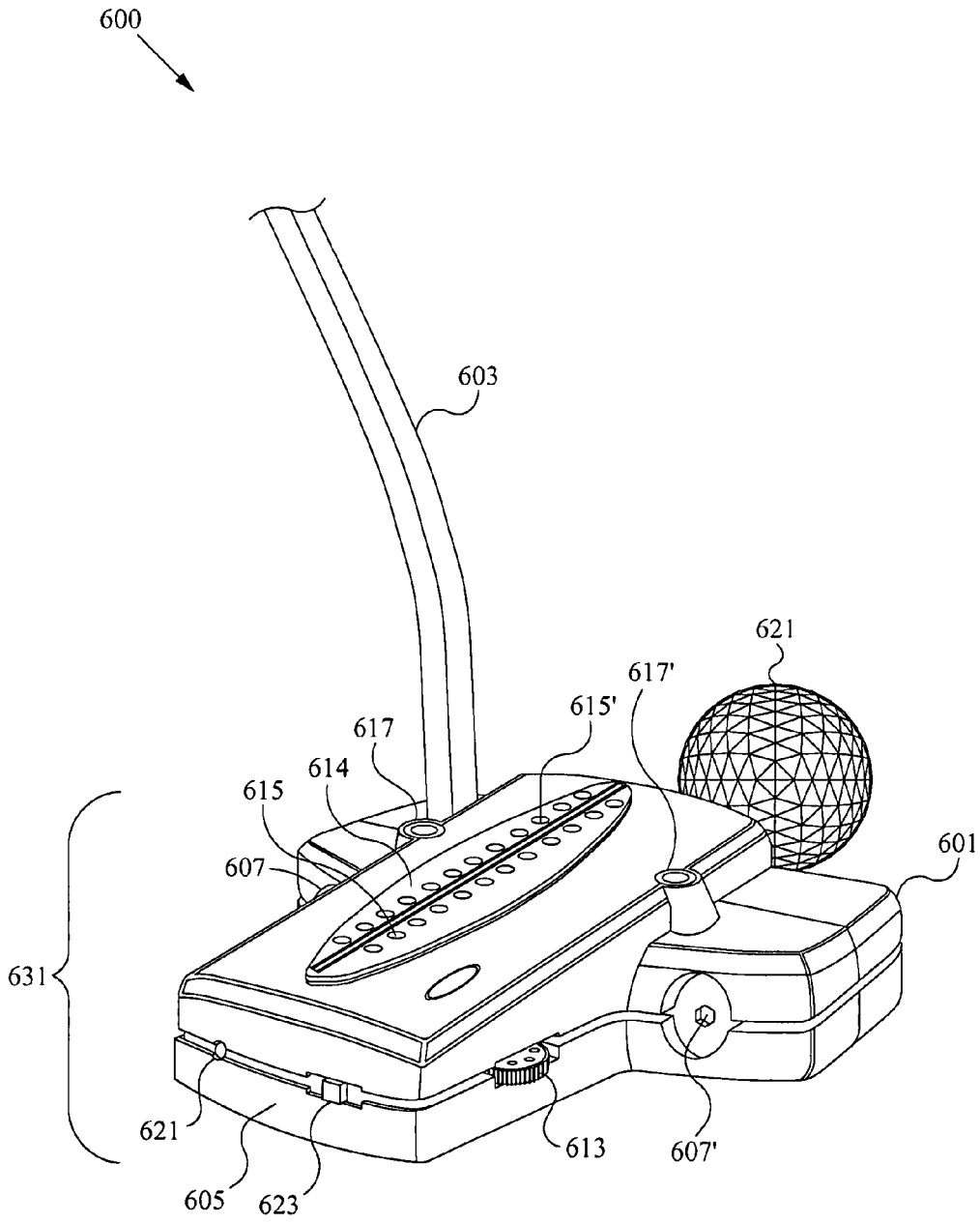
FIG. 6B shows a view an alignment module/tempo module detachably coupled to a putter substrate, wherein the alignment module/tempo module includes an array of lights, a switch feature, a charging port and a sensitivity adjustment features, in accordance with the embodiments of the invention.
Figure 6C:
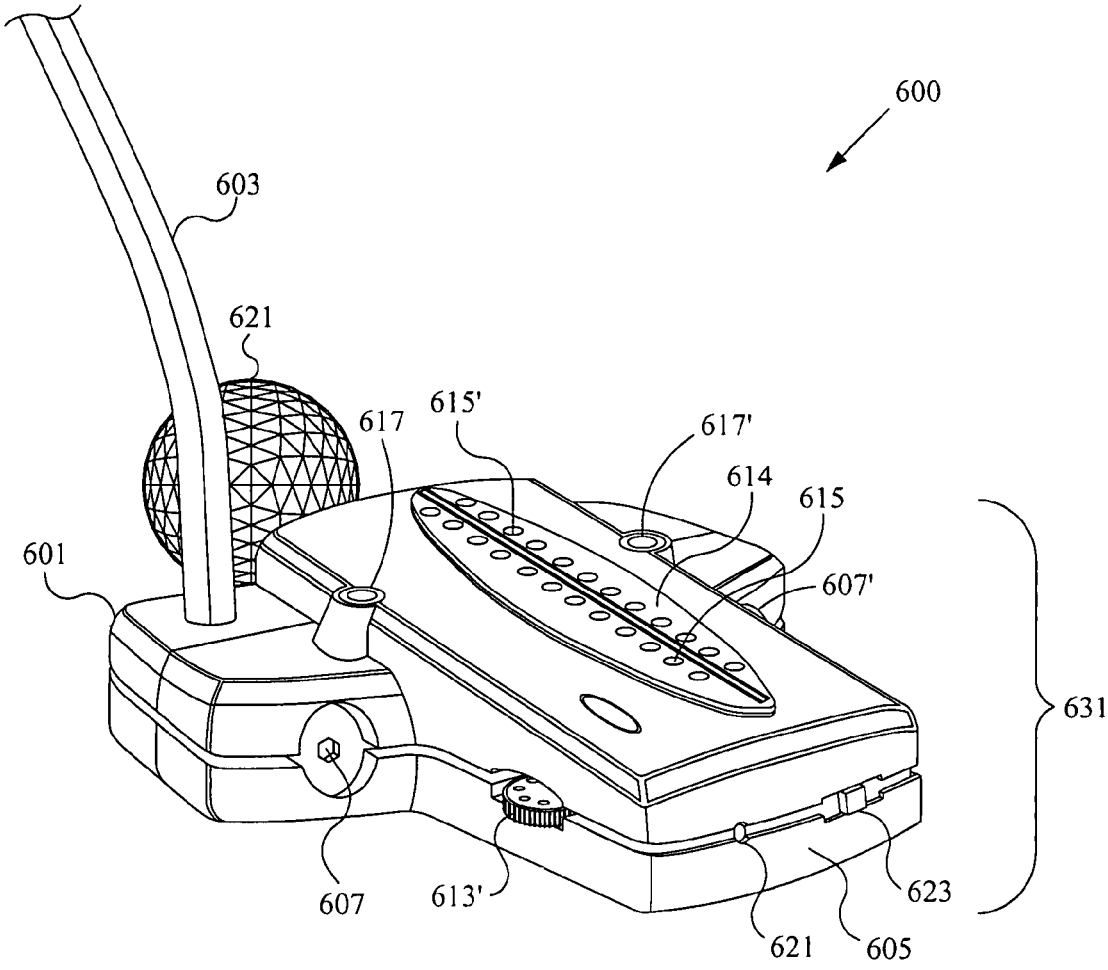
FIG. 6C shows an alternative view of the alignment module/tempo module detachably coupled to a putter substrate, wherein the alignment module/tempo module includes an array of lights, a switch feature, a charging port and a sensitivity adjustment features, in accordance with the embodiments of the invention.
Figures 7A, 7B, 7C:
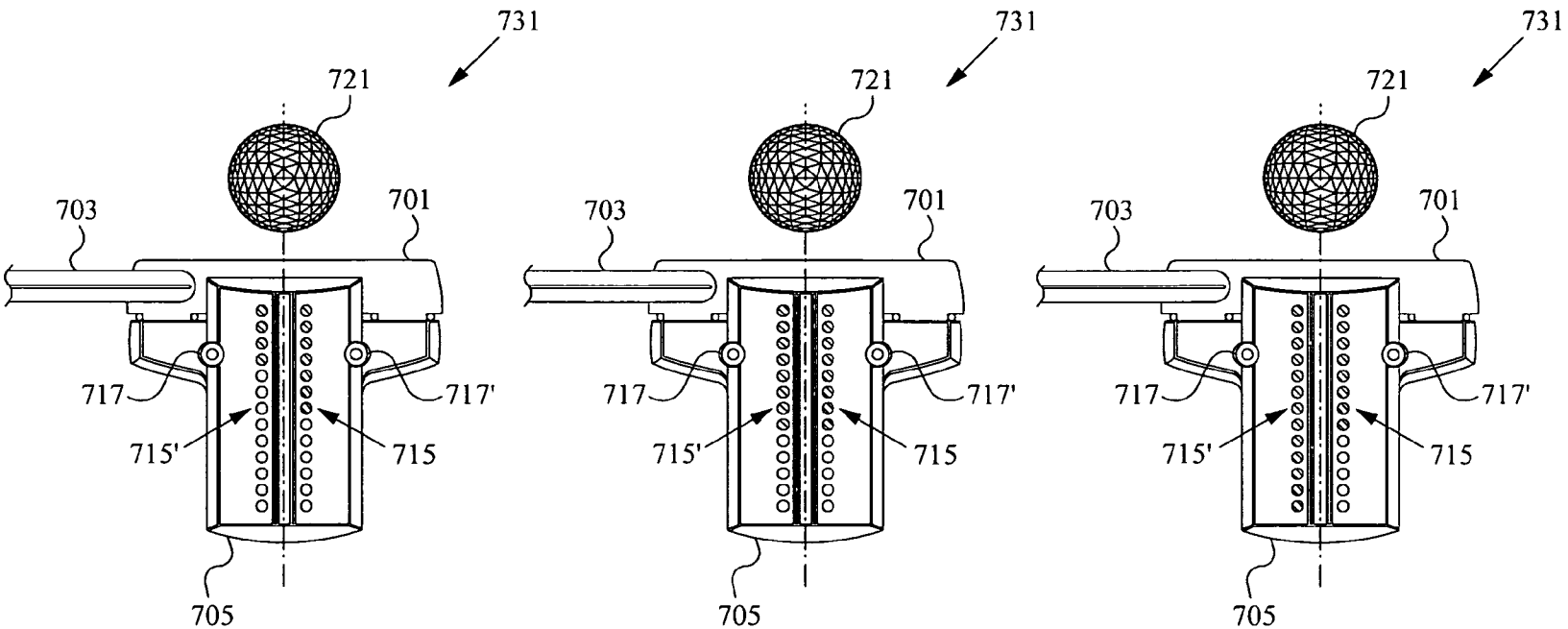
FIGS. 7A-C illustrate an alignment/positioning module detachably coupled to a putter substrate to form a putter head, wherein the alignment/positioning module includes an array of lights configured to selectively illuminate based on the angular position of the putter head with respect to a target, in accordance with the embodiments of the invention.

Referring now to FIGS. 6B-C, in accordance with further embodiments of the invention a putting system 600 includes a putter substrate 601, a handle 603 and a module 605 that detachably couples to the putter substrate 601 through one or more attachment features 607 and 607' to form a putter head 631, such as described above. The module 605 preferably includes two directional light displays 617 and 617' that indicate an alignment of the putter head 631 with a target. The light displays 617 and 617' are preferably 5 mm "bug eye" light emitting diodes that illuminate green or any other suitable color when the putter head 631 is aligned with the target. One of the directional light displays 617 and 617' can be configured to illuminate alone or with a color different from that of the other the of direction light displays 617 and 617', when the putter head 631 is out of alignment with the target.

The module 605 preferably includes a built-in battery (not shown) that is rechargeable using an electrical charger (not shown) that plugs into a charging port 621 on a back portion of the module 605. The module 605 can also be configured to be directionally programmable, such that the module 605 records and recalls an alignment position. For example, the module 605 includes an internal compass mechanism (not shown). In operation, a micro-processor (not shown) records position readings from the internal compass mechanism and stores the position readings on a memory device (not shown). The module 605 includes software or firmware that allows the module 605 to recall or recognize when the module 605 has been returned to an alignment position with the same or similar position readings. The module 605 then indicates its alignment with the target through the directional light displays 617 and 617'. Accordingly, a target module, such as the target module 900, described with reference to FIGS. 9A-C, is not required.

Still referring to FIGS. 6B-C, the module 605 preferably includes a switch 623. The switch 623 is preferably a three-way switch that allows the module 605 to be switched between tempo operation mode, alignment operation mode and an off mode. In operation, when the switch 623 is moved all the way to one side, the module 605 is in alignment operation mode, when the switch 623 is moved all the way to the other side, the module 605 is in tempo operation mode and when the switch 623 is in a center position, the module 605 is in the off mode.

In alignment operation mode, one or more of the displays 617, 617' and 614 indicate alignment of the putter head 631 with a target, as described above and below with reference to FIGS. 7A-C and FIGS. 8A-C. In addition to the adjustment feature 613 to adjust a sensitivity of the module 605 to detect, measure, determine and/or monitor changes in angular alignment of the putter head 631, the module 605 also preferably includes a second adjustment feature to adjust sensitivity of the module 605 to detect, measure, determine and/or monitor changes in tempo while the module 605 is in the tempo operation mode.

With the module 605 is in tempo operation mode, the display 615 can be used to indicate both a length of a stroke of the putter head 631 and a tempo of the putter head 631. For example, a rate that lights 615 and/or 615' within the display 614 blink can indicate a tempo of the putter head 631 while the number of lights 615 and/or 615' illuminated within the display 614 can indicate a length of a stroke of the putter head 631. Preferably, the module 605 includes a internal metronome mechanism that emits an audible tone or beat pattern representative of an intended, ideal or real tempo of the putter head 631. The module 650 also preferably includes one or more accelerometers to measure that actual tempo of the putter head 631 as the putter head 631 swings back and forth through a putting motion.

In accordance with a preferred embodiment of the invention, lights 615 on one side of the display 614 provide a visual representation of the actual tempo and/or length of a putting stroke, while lights 615' on the other side of the display 614 provide a visual representation of an intended or ideal tempo and/or length of the putting stroke. Accordingly, the sets of lights 615 and 615' provide a comparison between a user's actual putting stroke and an intended or ideal putting stoke and thus help the user to match his or her putting stroke with the intended or ideal putting stroke in real time. The module 650 can also be configured to store and replay a visual and/or audio representations of an executed putting stroke, which can be played back or compared to other or subsequent putting strokes in real time, such as described above.

Figures 8A, 8B, 8C:
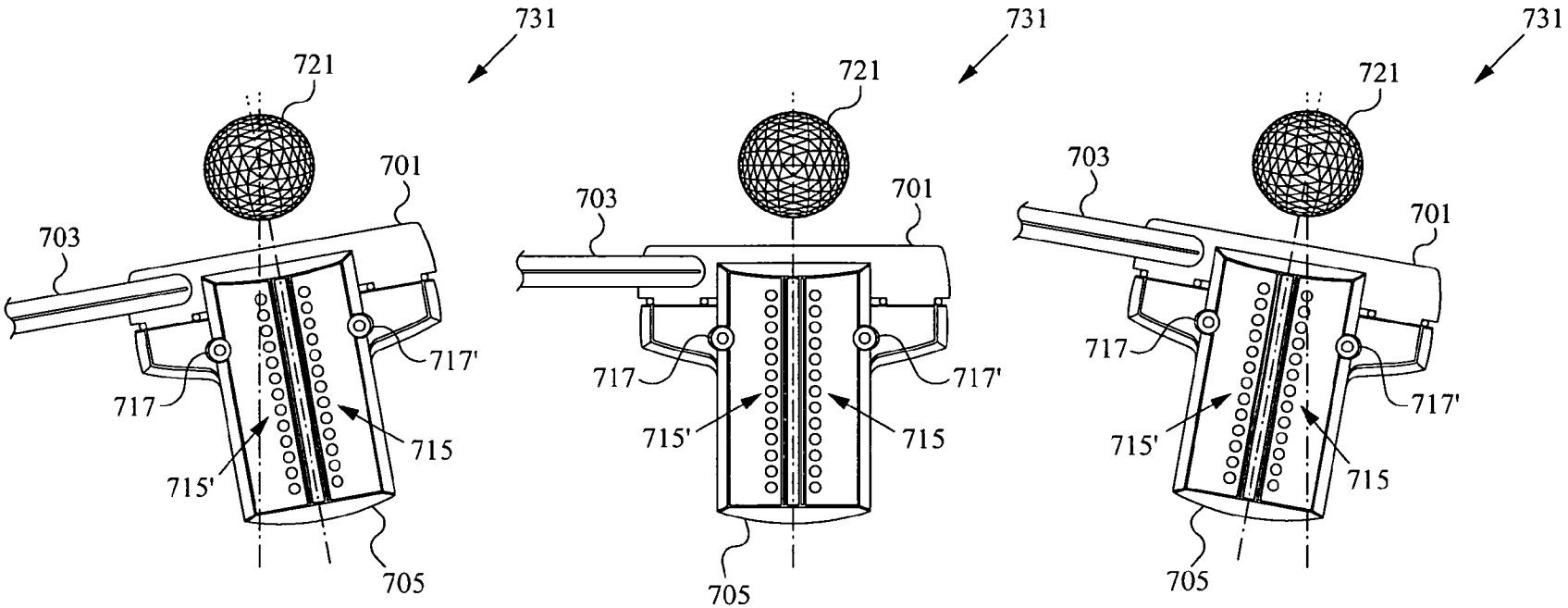
FIGS. 8A-C illustrate a range of positions for the alignment/positioning module shown in FIGS. 7A-B that lead to the selective illumination of the array of lights based on the angular position of the putter head with respect to the target, in accordance with the embodiments of the invention.

Referring to FIGS. 7A-C and FIGS. 8A-C, FIGS. 7A-C are used to show an exemplary light display outputs when the putter head 731 is aimed at the target at corresponding angles represented in FIGS. 8A-C. In operation, a module 705 is coupled to a putter substrate 701 with a handle 703 to form a putter head 731. The module 705 includes a display with a rows of lights 715 and 715'. Lights within each of the rows of lights 715 and 715' are configured to selectively light-up to provide the visual representation of an angular alignment of the putter head 731 with a target (not shown) and in a position to strike a golf ball 721. For example, when the putter head 731 is askew to the right (FIG. 8A), more lights on the right row of lights 715 are illuminated (FIG. 7A) indicating that the putter head 731 should be moved to the left; when the putter head 731 is askew to the left (FIG. 8C), more lights on the left row of lights 715' are illuminated (FIG. 7C) indicating that putter head 731 should be moved to the right; and when the putter head centered or aligned (FIG. 8B) with the target and/or a target module 900 (FIG. 9A-C), the number of light lights illuminated in the right row of lights 715 and the left row of lights 715' are equal.

In further embodiment of the invention, the lights within the rows of lights 715 and 715' are turned on and off in a repetitive back and forth manner. The repetitive back and forth manner is preferably synchronized with a back and forth motion of the putter head 731 as the putter head 731 is moved back and forth with a putting motion. In this way the rows of lights 715 and 715' provide a visual representation of the tempo of the putter head 731. In accordance with this embodiment of the invention, the putting system is also configured to provide an audio representation of the tempo of the putter head 731 as putter head 731 is moved back and forth with a putting motion. Referring to FIG. 1, the audio representation of tempo is generated from a speaker and/or from an earphone 135 that plugs into the earphone jack 131 located on a portion of a handle 105. Alternatively, the audio representation of tempo is transmitted by wireless means to a suitable output device, such as a set of wireless headphones.

Referring now to FIGS. 9A-C, the putting system in accordance with the embodiments of the invention includes a target module 900. The target module 900 preferably includes a housing 901, a collapsible stand 911 and a set of alignment guides 905 and 905' for aligning, positioning or locating the target module 900 in line with a target and/or a putter. The alignment guides 905 and 905' are preferably also collapsible, such that the target module 900 can be readily stored. As described above, the target module 900 includes a transmitter unit 916. The transmitter unit 916 preferably includes an array of infrared diode transmitters 917 and 918 that transmit sets of infrared alignment signals. The sets of infrared alignment signals are received and detected by the receiving unit 516 (FIG. 5) of the positioning module 405 (FIGS. 4 and 5), such as described above. Based on the intensities of the alignment signals received and detected by the receiving unit 516 and based on known geometries or spatial arrangements of the transmitters 917 and 918 and detectors 517 and 518, the computing circuit 524 (FIG. 5) calculates or determines angular positions or alignment of the putter head 431 (FIG. 4) with respect to the target and/or the target module 900. The computing circuit 524 then generates an output that is displayed on a display to provide the visual representation of the angular position or the alignment of the putter head 431 with respect to the target and/or the target module 900.

Figure 10A:
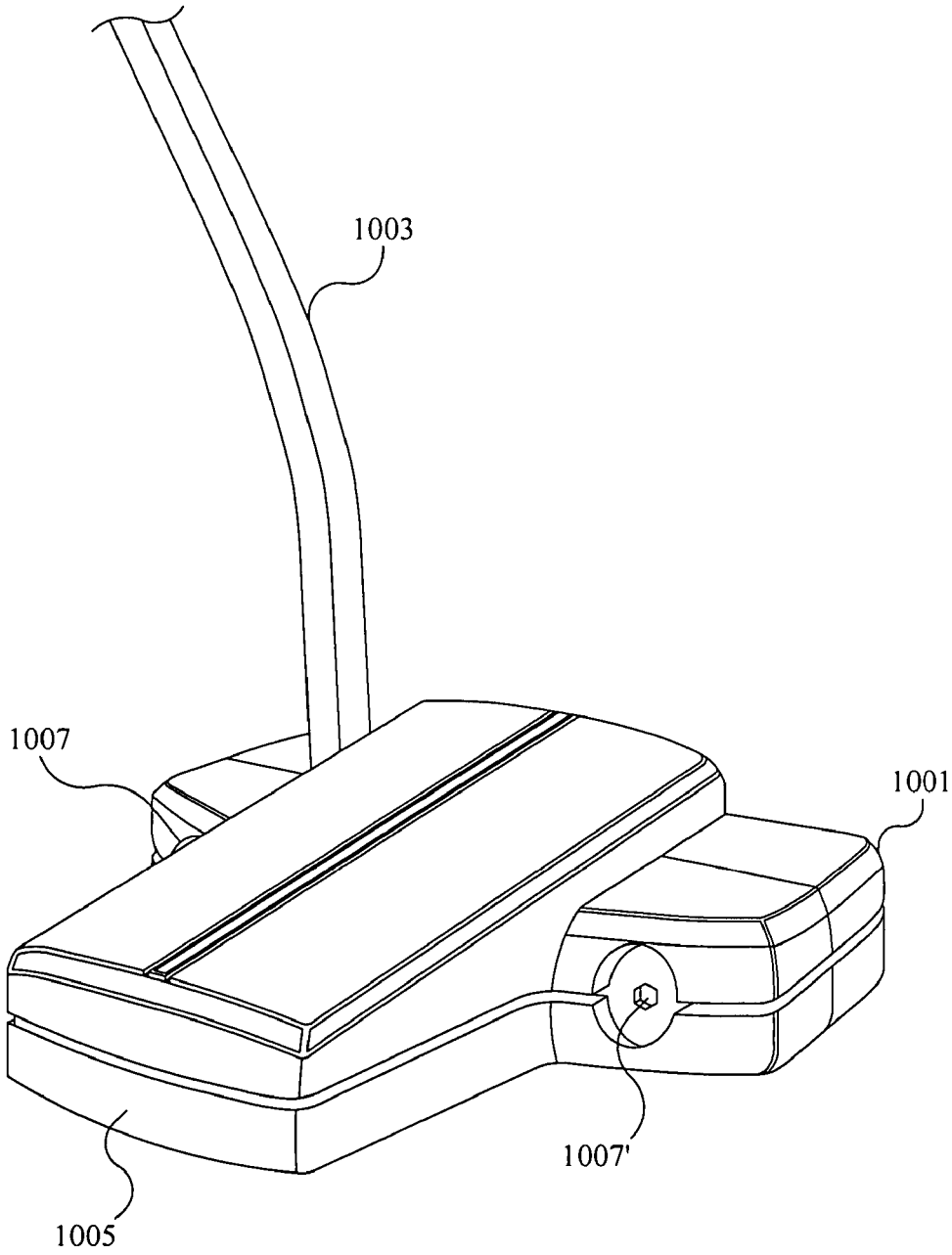
FIGS. 10A-C show a module with a range of weights that are each configured to detachably couple to a putter substrate, in accordance with the embodiments of the invention.
Figure 10B:
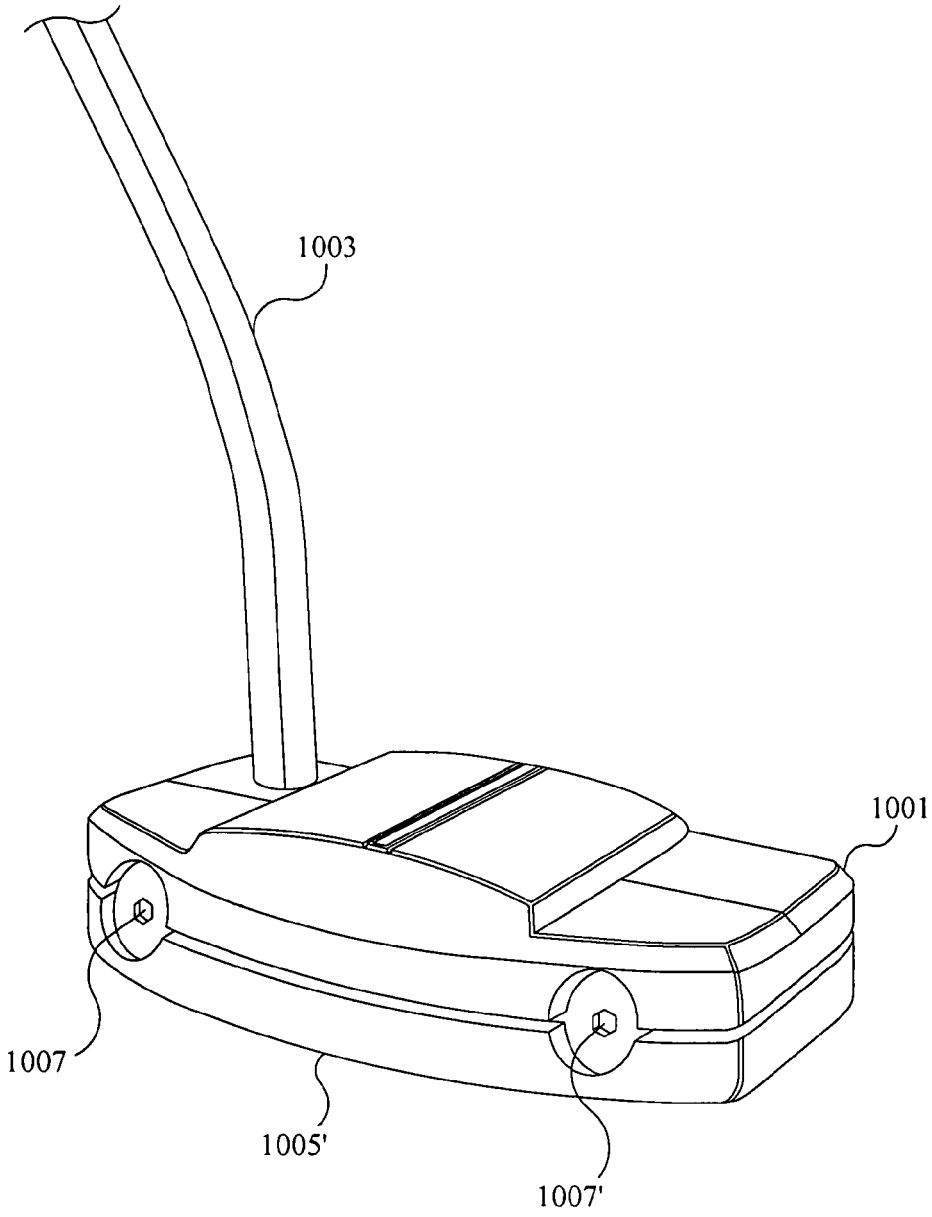
Figure 10C:
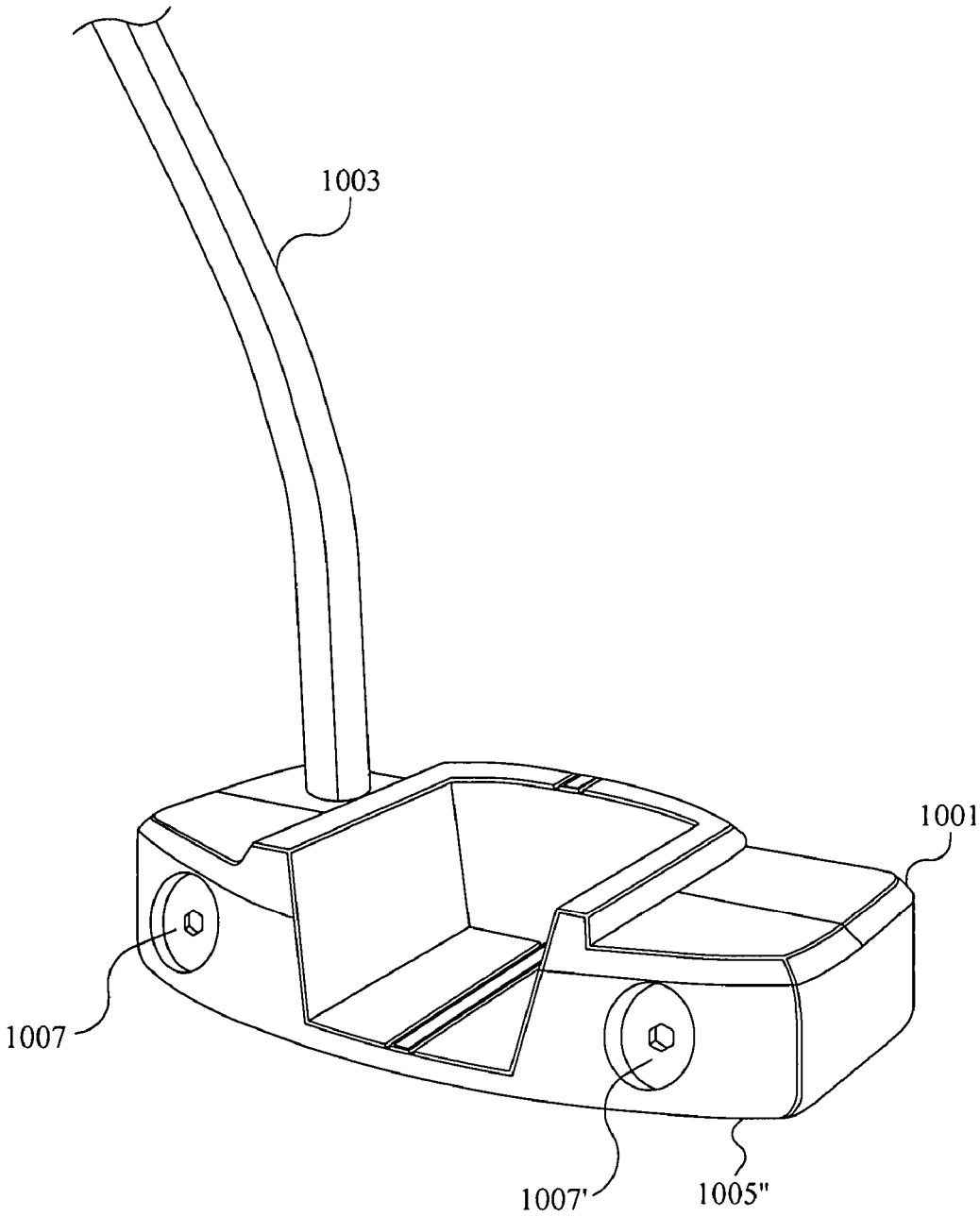

Referring now to FIGS. 10A-C, in accordance with still further embodiments of the invention a putting system include a putter substrate 1001, a handle 1003 and a plurality of weight module 1005, 1005' and 1005" that detachably couple to the putter substrate 1001 through one or more attachment features 1007 and 1007' to form putter heads. The weight modules 1005, 1005' and 1005" have a range of weights and are configured to be interchangeably coupled to the putter substrate 1001 to provide a golfer with a range of putter weights and weight balances.

Figure 11A:
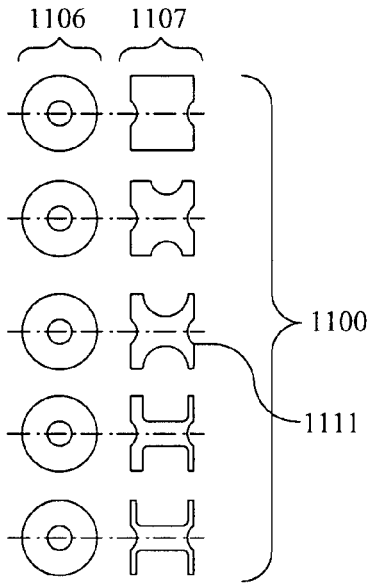
FIGS. 11A-C show a module with a receiving cavity for interchangeably holding weights from a set of weights having a range of weights, in accordance with the embodiments of the invention.
Figure 11B:
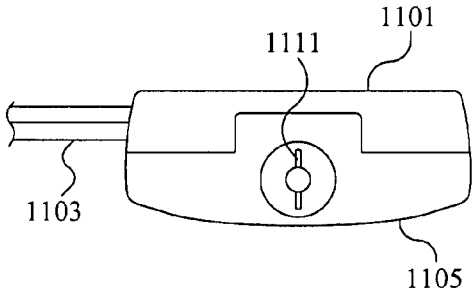
Figure 11C:
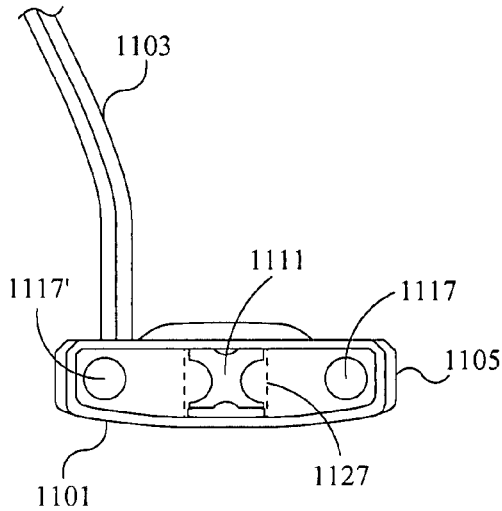

Referring now to FIGS. 11A-C, in accordance with still further embodiments of the invention a putting system include a putter substrate 1101, a handle 1103 and a weight module 1105 that detachably couples to the putter substrate 1101 through one or more attachment features 1117 and 1117' to form a putter head. The putting system further includes a set of weights 1100 that have a range of weights as shown by the side views 1107 and preferably have similar volumetric dimensions or displacement volumes as shown by the top views 1106. Each of the weights within the set of weights 1100 is configured to interchangeably fit into a receiving cavity 1127 of the weight module 1105, as illustrated with weight 1111, to provide a golfer with a range of putter weights and weight balances.

Figure 12A:
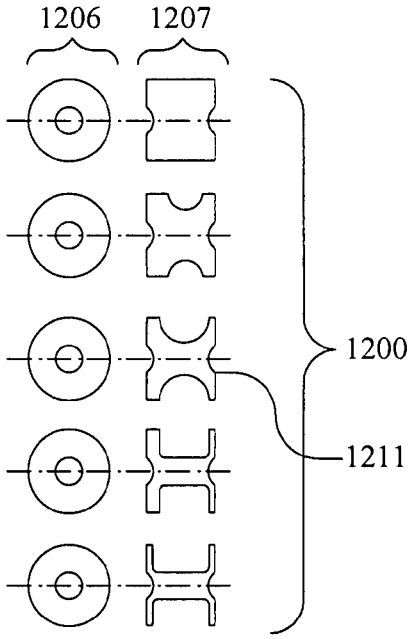
FIGS. 12A-C show a module with a plurality of receiving cavities for interchangeably holding weights from a set of weights having a range of weights, in accordance with the embodiments of the invention.
Figure 12B:
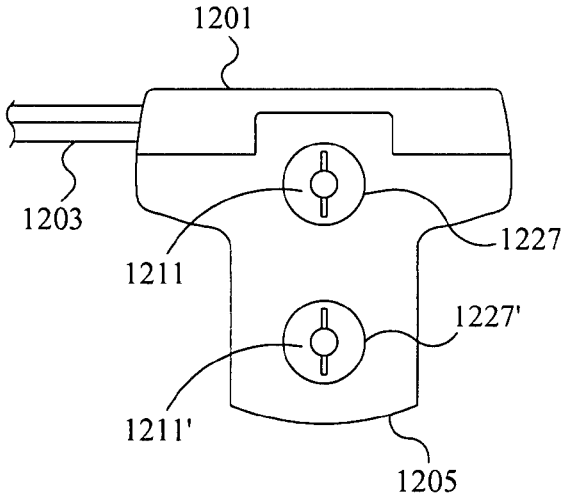
Figure 12C:
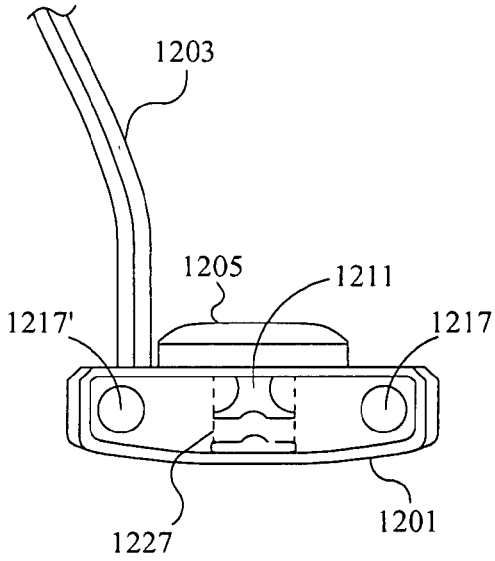

Referring now to FIGS. 12A-C, in accordance with alternative embodiments of the invention a putting system include a putter substrate 1201, a handle 1203 and a weight module 1205 that detachably couples to the putter substrate 1201 through one or more attachment features 1217 and 1217' to form a putter head. The putting system further includes a set of weights 1200 have range of weights as shown by the side views 1207 and preferably have similar volumetric dimensions or displacement volumes as shown by the top views 1206. Each of the weights within the set of weights 1200 is configured to interchangeably fit into a plurality of receiving cavities 1227 and 1227' of the weight module 1205, as illustrated with weights 1211 and 1211', to provide a golfer with a range of putter weights and weight balances.

Referring now to FIGS. 11A-C and FIGS. 12A-C, the interchangeable weights within the sets of weights 1100 and 1200 are preferably asymmetric in their weight distribution. For example, a top portion of each of the interchangeable weights 1100 and 1200 are heavier or lighter than the corresponding bottom portion, as indicated by the thicknesses shown in the side views 1107 and 1207. Accordingly, not only do the interchangeable weights 1100 and 1200 provide a golfer with a range of putter weights and weight balances, such as described above, the interchangeable weights 1100 and 1200 also allow the golfer to control the weight distribution or center of gravity of the putter.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiments chosen for illustration without departing from the spirit and scope of the invention. Specifically, it will be apparent that the system of the present invention can be used to detect, determine, measure and/or monitor alignment, angular position and/or tempo of any number of stationary or moving objects.

What is claimed is:

1. A system for putting comprising:

a) a putter assembly with a putter substrate and a handle;

b) a plurality of modules configured to detachably couple to the putter substrate to form a putter head, wherein at least one of the plurality of modules is an alignment module configured to indicate an alignment of the putter head with a target from the putter head; and c) a target module with a transmitter unit for transmitting alignment signals in a path between the target and the putter head and wherein the alignment module includes a receiver unit for receiving the alignment signals, wherein the transmitter unit includes one or more of a radio transmitter and an optical transmitter for generating the alignment signals.

2. The system of claim 1, wherein the alignment module includes a display for indicating the alignment of the putter head with the target.

3. The system of claim 2, wherein the display includes an-array of light emitting diodes.

4. The system of claim 1, wherein the alignment module includes an audio means for indicating the alignment of the putter head with the target.

5. The system of claim 1, wherein the receiver unit includes a plurality of detectors and a computing circuit for determining an angular alignment of the putter head as the putter head is moved back and forth through a putting trajectory.

6. A system for putting, the system comprising:

a) a positioning module coupled to a putter substrate to form a putter head, wherein the positioning module includes a receiver unit for detecting infrared optical signals as the putter substrate is moved back and forth through a putting trajectory; and b) a target module for positioning near a putting target with a transmitter unit for emitting the infrared optical signals in a path between the target and the putter substrate, wherein the positioning module provides one or more of an indication of the position of the putter head with respect to the target module based on the infrared optical signals detected by the receiver unit, wherein the transmitter unit includes an array of light emitting diodes for emitting the infrared optical signals and wherein the receiver includes an array of infrared detectors for detecting an intensity of the infrared light emitted by the array of light emitting diodes.

7. The system of claim 6, wherein the receiver unit includes a computing circuit for determining an angular alignment of the positioning module as the putter substrate is moved back and forth through the putting trajectory based on the intensity of the infrared light detected by the array of infrared detectors.

8. The system of claim 7, wherein the positioning module includes a display that provides a visual representation of the angular alignment of the positioning module respect to the target module.

9. The system of claim 8, wherein the display includes a set of light emitting diode bars.

10. The system of claim 6, wherein the positioning module is configured to detachably couple to the putter substrate.

11. The system of claim 10, further comprising a tempo module for detachably coupling to the putter substrate and for indicating a tempo of the putter substrate as the putter substrate moves back and forth through the putting trajectory.

12. A system for putting comprising:

a) a putter assembly with a putter substrate and a handle; and b) a plurality of modules configured to detachably couple to the putter substrate to form a putter head, wherein at least one of the plurality of modules is an alignment module configured to indicate an alignment of the putter head with a target from the putter head; and c)a target module with a transmitter unit for transmitting alignment signals in a path between the target and the putter head, wherein the alignment module includes a receiver unit for receiving the alignment signals, the transmitter unit includes one or more of a radio transmitter and an optical transmitter for generating the alignment signals and the receiver unit includes a plurality of detectors and a computing circuit for determining an angular alignment of the putter head as the putter head is moved back and forth through a putting trajectory.

13. The system of claim 12, wherein the alignment module includes a display for indicating the alignment of the putter head with the target.

14. The system of claim 13, wherein the display includes an array of light emitting diodes.

15. The system of claim 12, wherein the alignment module includes an audio means for indicating the alignment of the putter head with the target.

16. The system of claim 12, further comprising a target module with a transmitter unit for transmitting alignment signals in a path between the target and the putter head and wherein the alignment module includes a receiver unit for receiving the alignment signals.

* * * * *